US005526746A

United States Patent [19]

Capdeboscq

[11] Patent Number: 5,526,746

[45] Date of Patent: Jun. 18, 1996

[54] DEVICE FOR HOOKING FLEXIBLE PRINTING PLATES ON A PRINTING CYLINDER

[75] Inventor: Bernard Capdeboscq, St. Just-Chaleyssin, France

[73] Assignee: SA Martin, Villeurbanne, France

[21] Appl. No.: 483,792

[22] Filed: Jun. 7, 1995

[30] Foreign Application Priority Data

Jun. 8, 1994 [FR] France ..... 94 07200

[51] Int. Cl.[6] ..... B41F 21/00

[52] U.S. Cl. ..... 101/415.1; 101/382.1; 101/389.1

[58] Field of Search ..... 101/415.1, 389.1, 101/382.1, 384, 383, 389, 385, 386

[56] References Cited

U.S. PATENT DOCUMENTS

| | | | |
|---|---|---|---|
| 1,923,925 | 1/1931 | Frankboner | 101/382.1 |
| 4,005,653 | 2/1977 | Arkell | 101/415.1 |
| 4,683,822 | 8/1987 | Sardella et al. | 101/415.1 |
| 5,103,729 | 4/1992 | Philpot | 101/415.1 |
| 5,241,907 | 9/1993 | Dorsam et al. | 101/415.1 |
| 5,402,721 | 4/1995 | Schultz | 101/389.1 |

FOREIGN PATENT DOCUMENTS

| | | | |
|---|---|---|---|
| 71171 | 2/1983 | European Pat. Off. | 101/389 |
| 0215645 | 3/1987 | European Pat. Off. . | |
| 993798 | 11/1951 | France | 101/415.1 |
| 2161696 | 7/1973 | France . | |
| 3102126 | 8/1982 | Germany | 101/389.1 |
| 4310359 | 10/1993 | Germany . | |
| 971674 | 11/1982 | U.S.S.R. | 101/389.1 |
| 752300 | 7/1956 | United Kingdom . | |
| 340223 | 12/1995 | United Kingdom | 101/382.1 |

*Primary Examiner*—Edgar S. Burr
*Assistant Examiner*—Anthony H. Nguyen
*Attorney, Agent, or Firm*—Hill, Steadman & Simpson

[57] ABSTRACT

A device for hooking flexible printing plates which have a supporting sheet with one or more printing motifs onto a rotary printing cylinder includes a front hooking strip having an almost U-shaped cross section engaged in a hook-shaped groove arranged along a surface of the cylinder. One or more stops are provided on the supporting sheet adjacent to the hooking strip and are received in a second groove formed in the cylinder, which has a cross sectional profile corresponding to the profile of the stops. The second groove can be in communication with third grooves extending at right angles thereto and the second groove and third grooves can be in communication with a source of vacuum to facilitate holding the flexible printing plate on the cylinder.

14 Claims, 4 Drawing Sheets

DEVICE FOR HOOKING FLEXIBLE PRINTING PLATES ON A PRINTING CYLINDER

BACKGROUND OF THE INVENTION

The present invention is directed to a device for hooking flexible printing plates on a printing cylinder located in a rotary printing machine.

Rotary printing machines are usually called flexographic printing machines and are often used in paperboard industry. In these machines, flexible printing plates are fitted on a cylinder which rotates so as to transfer the ink onto a surface to be printed. In these machines, sheets of cardboard are taken from the top of a pile and carried individually and successively through the printing station and, eventually, through a die-cutting station and then, finally, are gathered in a delivery station.

With this kind of machine, the action of exchanging printing plates on the printing cylinder is usually troublesome, specifically the action of fitting the printing plate which is to be executed quickly in order not to unnecessarily delay the machine during the change of a sheet size or a printing size. A printing plate usually includes one or several rubber or plastic printing forms, which are fitted on a flexible support sheet consisting either of a strong paper or of a rubber or plastic material, so that they may be applied and wrapped around a printing cylinder.

One of the first means known for hooking a printing plate on a cylinder consists in clamping the sheet on a wooden piece which belongs to the cylinder. However, with long runs, these clamps have the tendency of damaging the supporting sheet as well as the wooden piece which has to be replaced regularly. Moreover, if the printing plate is in the wrong position, it is necessary to completely take it off the cylinder and then reposition it on the cylinder, which may double or even triple the downtime of the machine.

Another hooking device includes a rigid strip at both the upstream and downstream ends of the printing plate. The upstream strip is engaged in a fixed groove of the cylinder, whereas the downstream strip engages in a jointed or adjustable groove in such a way that the printing plate can be placed under tension. However, the dimension of the printing plate has to be rather accurate and problems about the means for setting the adjustable groove into operation can occur.

In fact, the real problem consists in keeping the whole of the printing plate applied on the cylinder, which does not necessarily involve a strong tensioning of the printing plate.

French Patent Documents FR 2,434,035 and FR 2,196,910 each reveal plate-supporting cylinders whose outer cylindrical surface is provided with a series of grooves connected through a radial aperture to an inner chamber of the cylinder in which a vacuum can be created by means of a vacuum pump. It is possible to arrange either a series of parallel circular grooves, or a groove meshing, or simply one groove running helicoidally along the cylinder. When these grooves are covered by the printing plate, tight spaces are created, which, once a vacuum is created in this space, will hold the printing plate on the cylinder.

The hooking device described in French Patent Document 2,196,910 includes two parallel grooves arranged side-by-side and made almost tangentially along a generatrix of the cylinder. The grooves open on their opposite sides so that one of them is destined to receive the front edge of the printing plate and the other receives the downstream edge.

These printing plate edges are held in position by means of bolts which extend radial across the grooves and engage in apertures threaded in the cylinder. However, this device is defective by the fact that the edges are positioned or held in position at only two or three points. Moreover, the insertion of the edges in the grooves can be achieved more or less easily depending on the thickness or the supporting sheet.

The hooking device described in French Patent Document FR 2,434,035 is based on the existence of fixing pawns or pins protruding from the cylinder and on which openings of the plate are engaged. The openings are arranged a little away from the front and downstream edge of the printing plate. A board is then inserted between these pins in order to keep the edges applied on the cylinder. Again, the position accuracy of the front edge cannot be guaranteed by the sole holding at these points.

The most common device, which is called a Matthews device, includes a hooking strip with a U-shaped cross section, which is mounted at one end on the printing plate. This strip is hooked in a corresponding groove of a printing cylinder having a U-shaped cross section. A series of elastic tensioners are fitted on the other end of the printing plate. Every tensioner consists of a U-shaped hook which can engage in another groove of the cylinder, which groove also has a U-shaped cross section. These elastic tensioners allow a strong tensioning of the printing plate on the cylinder.

However, since the fitting of every tensioner may be fastidious, it is also possible to replace these tensioners by a large adhesive strip, which fixes directly the downstream edge of the printing plate to the cylinder.

Even though the device functions satisfactorily, there still remains the risk that the fixtures of the downstream edge undergo release of the tension, which release may further progress until the printing plate falls between the inking cylinders or travels through the rest of machine, if the latter is still in operation. While some devices for mechanical tensioning or magnetic fastening of the printing plate diminishes this risk, they have the drawback of creating a complicated setting operation and of a complex adjustment of the ultimate position for the plate.

SUMMARY OF THE INVENTION

The object of the present invention is to provide a device for hooking printing plates, which includes a front strip with an almost U-shaped cross section which engages in a groove-hook arranged along the generatrix of the cylinder, as well as means for fastening and tensioning the downstream edge of the printing plate, which should be such that the unhooking of the front edge is almost impossible in case of a release of tension caused by the means for fastening the downstream edge. However, this device must still remain simple to handle and not be excessive in cost.

To accomplish these aims, the present invention is directed to an improvement in a device for hooking flexible printing plates on a printing cylinder located in a rotary printing machine, the printing plate comprising at least one printing motif fitted on a supporting sheet which has ends with a front hooking strip for engaging in a first hook-shaped groove arranged around the generatrix of the cylinder, as well as means for fastening and tensioning a downstream edge of the printing plate on the cylinder. The improvements are the printing plate sheet being provided with one or more stops on a face of the sheet directed toward the cylinder and positioned adjacent, but a little back of, the front hooking strip, said stops being positioned and received in an additional or second groove with a cross section profile corresponding to the profile of the stops, said second groove is arranged parallel and close to the first hook-shaped groove.

Then, the hooking strip can only be disengaged from its groove if the stops are previously taken out of their own second groove, which suggests that the supporting sheet of the printing plate must be raised well above a tangential plane of the cylinder passing through the hooking device. In practice, a simple tension release of the sheet causes only some whipping in the rear part of the printing plate, but very rarely a raise of the upstream part. Thus, the stops which remain in position ensure also the holding of the hooking strip.

According to the preferred embodiment, the second groove of the stops is linked by means of a series of radial channels to an inner chamber of the cylinder, in which a vacuum has been created. Moreover, the printing plate includes at least a stop at each of its lateral edges. The lateral stops will limit the space therebetween in the area of the second groove so that a vacuum may be created, which fact confirms the position of these stops.

Usefully, the second groove for the stop is completed with a series of cross-grooves having the shape of an arc of a circle. As an alternative, the second groove for the stop is linked to a series of parallel circular grooves arranged on the whole outer circumference of the cylinder. This arrangement allows a particularly good holding of the front part of the printing plate adjacent to the second groove for the stop.

As another alternative, the second groove for the stops consists of a series of sub-grooves arranged end-to-end, which do not communicate between themselves. Every sub-groove can possibly communicate with several additional cross-grooves. With this arrangement, a stop, generally a central stop, occupies one of the sub-grooves. Thus, one can be rid of the lateral stops, which fact facilitates the lateral positioning of the printing plate.

When the circular grooves are made on the whole circumference of the cylinder, a separation is preferably installed, which will allow a dividing of these grooves into two parts, including an upstream part and a downstream part. The upstream and downstream parts are linked independently to the inner chamber having the vacuum. This structure allows a fitting of a printing plate which is shorter and which plate stops at the point or location of the separation.

Usefully, if a sheet overlaps the separation, it undergoes a slight bending or embossing at its downstream edge in order to form a transverse cavity which allows an increase in the vacuum surface and, hence, an increase in the holding strength. Alternatively to the bending or embossing, a thin strip can be glued under the downstream edge of the printing plate. Alternatively, a series of cross-grooves can be made on the downstream side of the separation.

According to a preferred embodiment, the cross sectional shape of the grooves is narrower at the top on the surface of the cylinder than at the bottom, when taken in the direction of the thickness of the cylinder. For instance, a groove may have a trapezoidal cross section whose bottom has a width in a range between 6 mm and 8 mm, whereas the opening is reduced to a range of 1 mm to 3 mm, and, preferably, is 2 mm. Such a groove ensures a steady holding of the printing plate, whose supporting sheets are thin. Moreover, the circulation of a vacuum is achieved with less load losses from one end to the other end of the groove by limiting the amount of loss from the non-covered parts of the groove.

Other advantages and features of the invention will be readily apparent from the following description of the preferred embodiments, the drawings and claims.

DESCRIPTION OF THE PREFERRED EMBODIMENTS

Figure 1:
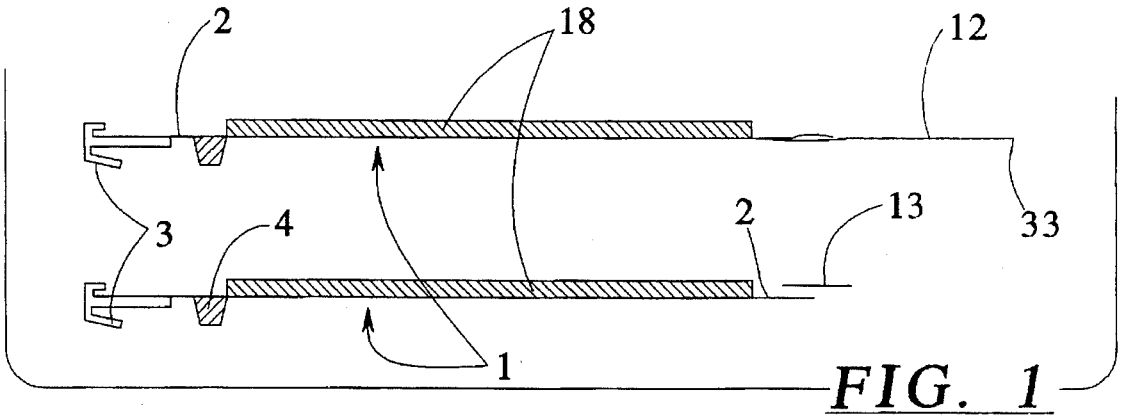
FIG. 1 is longitudinal cross sections of two printing plates according to the present invention.

The principles of the present invention are present invention are particularly useful when incorporated in a printing plate 1 of FIG. 1, which is formed by a thin and flexible supporting sheet 2 made out of rubber or plastic and on the outer face of which printing motifs 18 are glued. The front edge of each of the sheets 2 is equipped with a large hooking strip 3 whose from has a U-shape when seen in cross section. A downstream edge of the sheet 2 is arranged so as to receive either an elastic tensioner 12 with a hook 33 or a removable adhesive strip 13, which strip may be a serf-adhesive tape. More specifically, each printing plate I has, on its front part, a series of stops 4 which are glued on the side of the strip 2 which faces the cylinder and are arranged close to the hooking strip 3.

Figure 2:
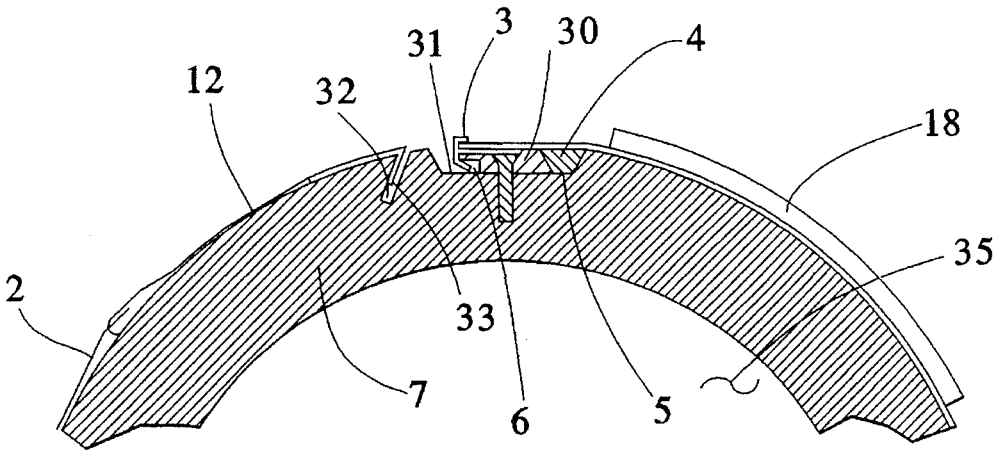
FIG. 2 is a partial cross section of a cylinder on which a printing plate is mounted according to the present invention.
Figure 3:
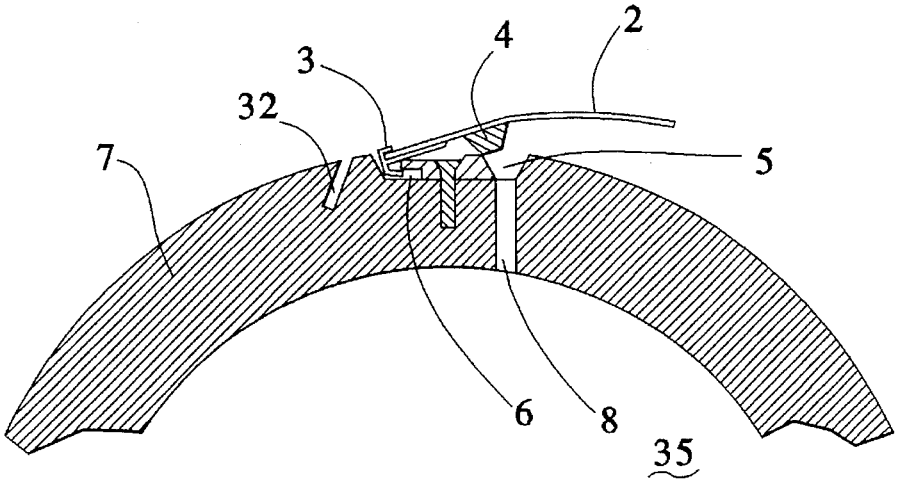
FIG. 3 is a partial cross sectional view similar to FIG. 2 showing a disengaging of the printing plate from the cylinder.

As best illustrated in FIGS. 2 and 3, a cylinder 7 includes a hooking bar 30 in a groove 31, which bar 30 coacts with the groove 31 to form an L-shaped hooking groove 6, which is designed to receive the hooking strip 3 of the printing plate 1. In fact, the bar 30 is mounted in the middle of a lengthwise cavity 31, which is large enough to leave free, on a rear side, an additional or second groove 5 for the stops 4 of the printing plate 1.

As may easily be gathered, the positioning of the printing plate I is achieved by engaging the hooking strip 3 in the groove 6 made by the bar 30. Additionally, the action of wrapping the printing plate around the cylinder engage each stop 4 in the groove 5. As soon as the printing plate has been applied on the cylinder, a tension release can no longer cause an unhooking, because of the security provided by the stops 4. Contrarily, in order to unhook the printing plate, it is necessary to bend the printing plate to an enlarged angle, as high as 30°, over the tangential plane passing through the bar 30 in order to first disengage the stops 4 from the groove 5 and then the hook 3.

Figure 5:
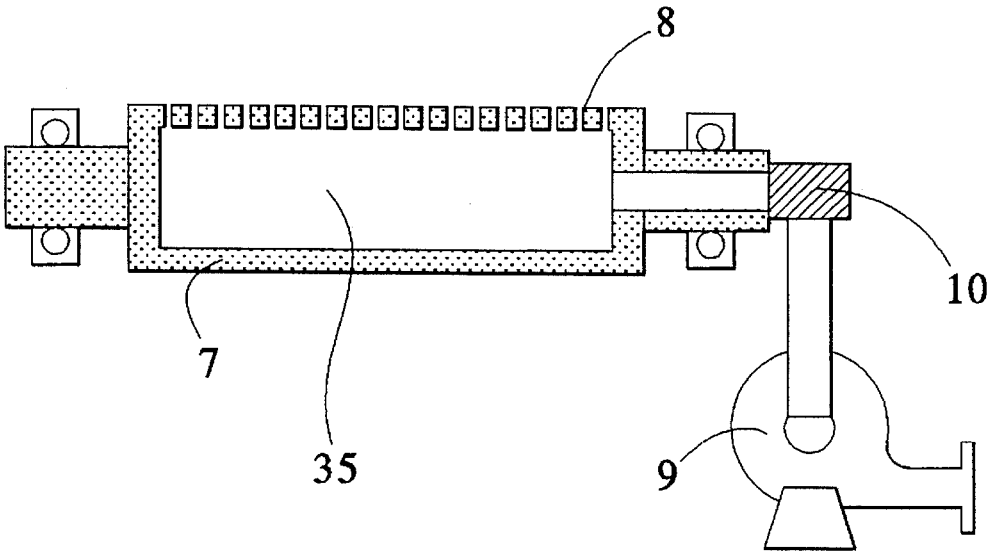
FIG. 5 is a schematic cross sectional view of a cylinder with a device which allows the formation of a suction in the grooves.

As best illustrated in FIG. 3, the groove 5 preferably communicates through radial channels 8 with an inner chamber 35 of the cylinder 7. As illustrated in FIG. 5, a vacuum can be created in the chamber 35 by means of a vacuum pump 9 connected through a rotary seal 10 to the interior or chamber 35 of the cylinder 7.

Figure 8:
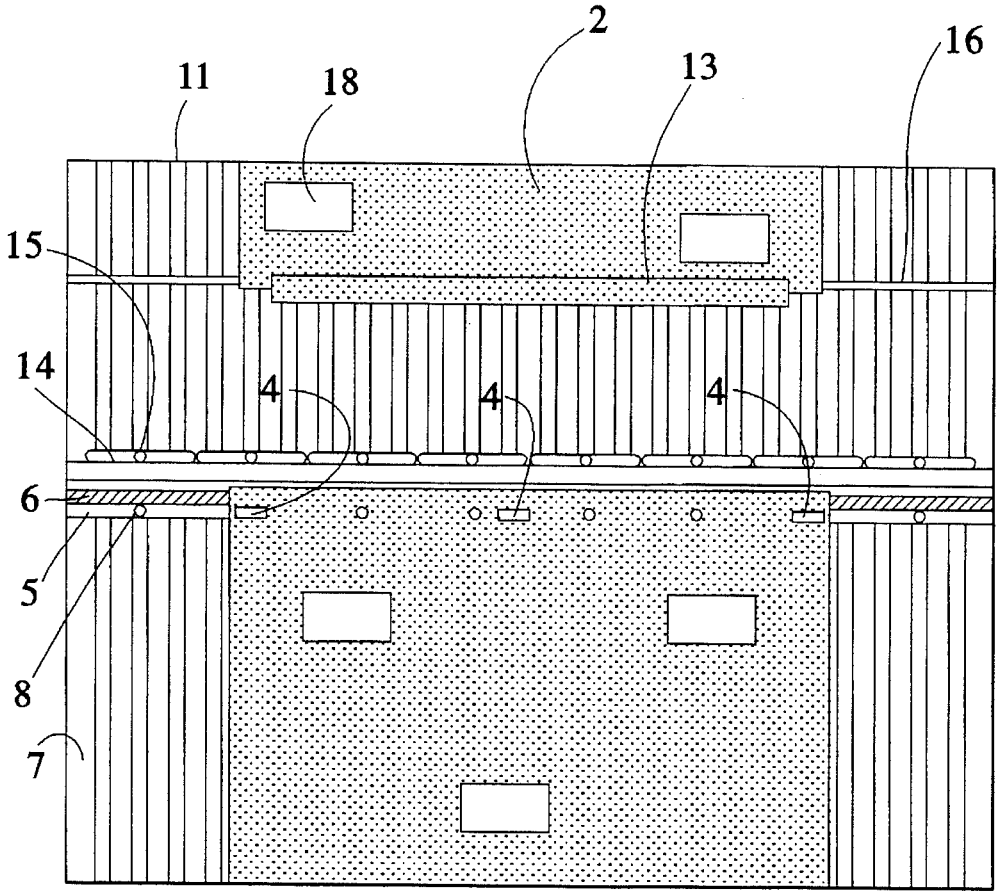
FIG. 8 is a front view of an arrangement for hooking the printing plates on a cylinder.

As shown in FIG. 8, two lateral stops 4 will close the groove 5, starting with the edge of the printing plate. In the space of the groove enclosed between these two stops, a vacuum can be created due to the radial channel 8. Each of the channels 8 has a small diameter so that when the groove 5 is not covered by a printing plate, the loss of vacuum due to exposed channels will be such as not to impede the creation of the vacuum in the area covered by the sheet 2.

Figure 4:
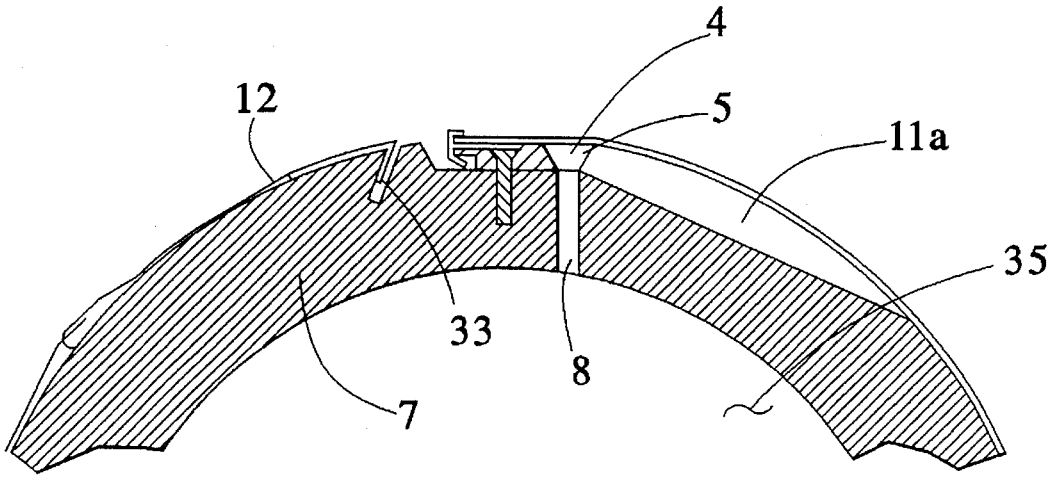
FIG. 4 is a partial cross sectional view similar to FIG. 2 which illustrates an additional groove.
Figure 6:
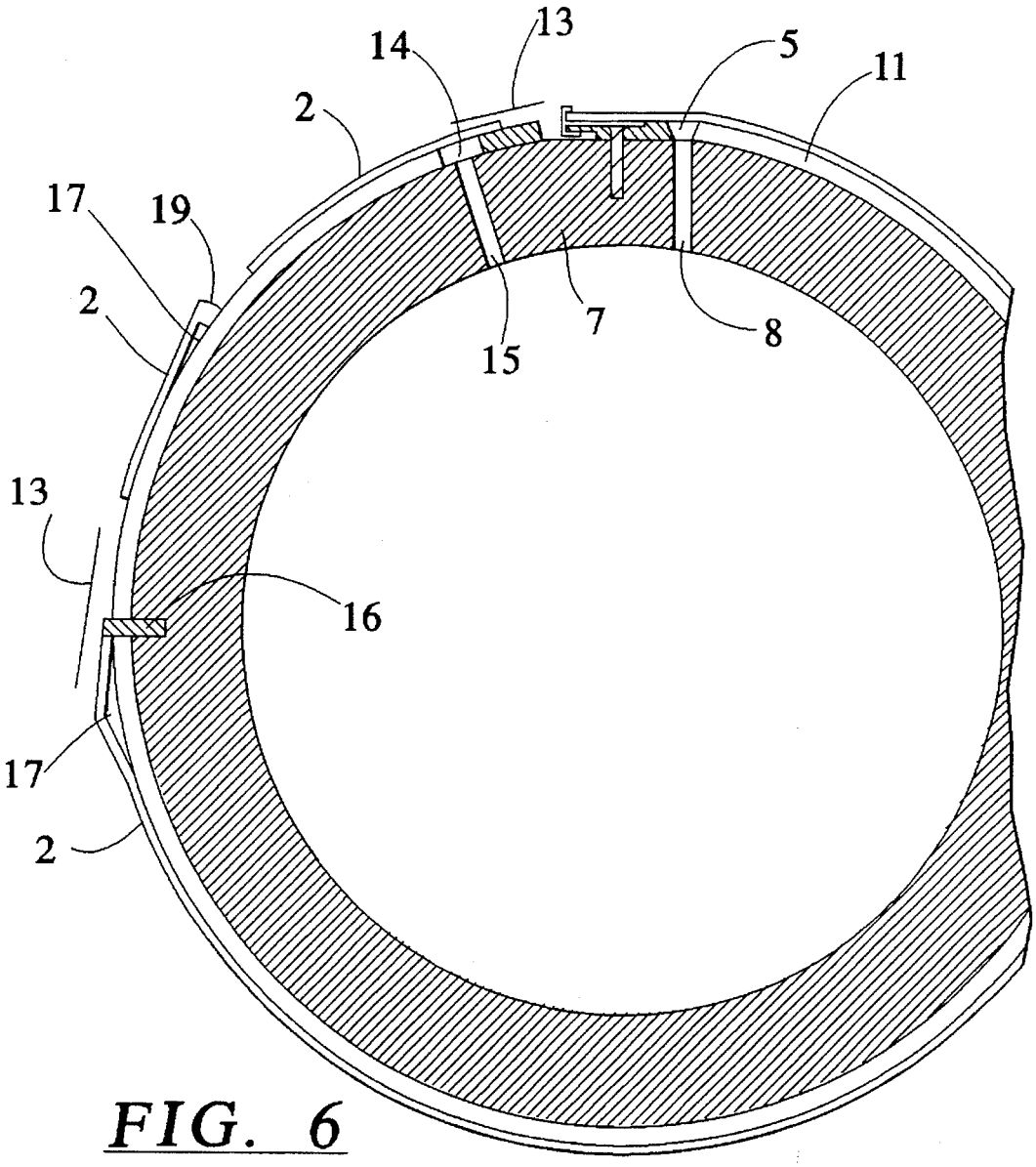
FIG. 6 is a partial cross section of a cylinder which illustrates various ways of hooking the downstream edge of the printing plate according to the present invention.

As best illustrated in FIGS. 4 and 6, the application of the pressure holding the from edge of the printing plate on the cylinder can be enhanced by having grooves, 11*a* which extend in an arc of a circle on the outer surface of the cylinder 7. These grooves extend at right angles to the groove 5 and are communicating therewith. The positioning of the stops in the middle of and on either side of the front edge does not impair the communication between the circular grooves 11*a* and the groove 5 for the stops and, thus, the channel 8. It should be noted that in FIG. 4, the grooves 11 a only extend for a portion of an arc, while the grooves 11 of FIG. 6 cover substantially the entire circumference of the cylinder 7.

According to another embodiment, the groove 5 consists of a series of individual sub-grooves 14 which are arranged end-to-end, as illustrated in FIG. 8. Every sub-groove 14 communicates with several grooves 11, on the one hand, and with a radial channel 8 which allows a vacuum to be created, on the other hand. In this case, a unique stop 4 is arranged generally in the middle of one of the individual sub-grooves 14, which will facilitate the adjustment of the lateral positions of the printing plate.

As best illustrated in FIG. 6, an embodiment includes a separation 16 which will divide the circumferential grooves 11 into two distinctive areas, with the front part of the groove being fed by radial channels 8 and the downstream part being fed by radial channels 15, which open into a sub-groove 14. Thus, if the dimensions of the printing plate are such that the downstream edge of the sheet 2 covers the sub-groove 14, the vacuum can be spread to the separation 16, which will act as a partition.

Figure 9:
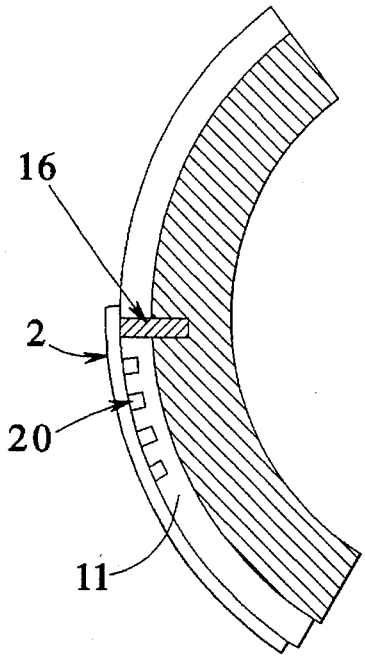
FIG. 9 is a partial cross sectional view of an arrangement for hooking the downstream edge of the printing plate.

However, if the printing plate is shorter and ends at the position of the separation 16, a bending and/or embossing at its downstream edge is foreseen in order to make a cross-cavity 17 which will facilitate the equalization of the vacuum from one groove 11 to another, which fact increases considerably the surface on which the atmospheric pressure is applied. This surface equalization can also be achieved by gluing a thin strip 19 under the downstream edge of the printing plate or, as an alternative, by making narrow cross-grooves 20 in the vicinity of the separation 16, such as illustrated in FIG. 9.

The peripheral groove made on the surface of the cylinder described in French Patent Documents FR 2,434,035 and FR 2,196,910 usually have a width of approximately 7 mm and a depth of 3 mm to 4 mm. Due to their dimensions, the supporting sheets of the printing plates are not properly carried when they are very thin, which is the case for most of the existing printing plates. It is then necessary to use a thick supporting sheet which is more rigid and which increases the cost and the difficulty of handling. However, it is very important to ensure a uniform holding of the printing plate in order to obtain optimum printing quality with a minimum of ink.

Figure 7:
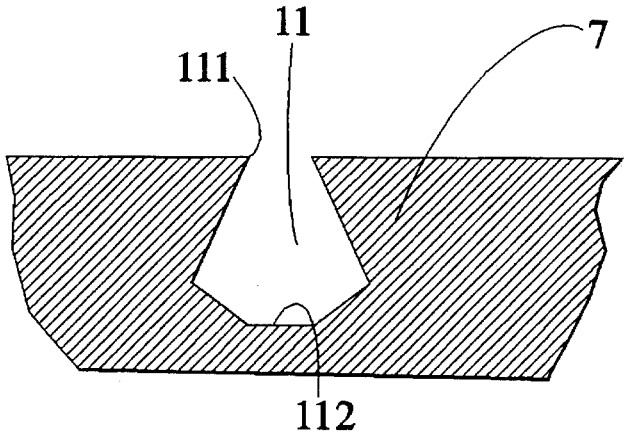
FIG. 7 is a cross sectional view of a groove in accordance with the present invention.

As best illustrated in FIG. 7, the grooves 11 associated to the hooking device according to the invention have a cross section which is very narrow at the top or mouth 111, for example 2 mm, and three or four times larger at the bottom 112, i.e., inward from the edge of the cylinder. Then, the pulling of the flexible supporting sheet 2 into the groove is almost eighty times less than before. In other words, for the same admissible pulling force on the sheet, the sheet may be three times thinner than it used to be without the structure of the groove 11 in FIG. 7.

As illustrated in FIGS. 1 and 4, the downstream end is held by tensioners 12, which terminate in a hook 33 which is received in a slot or groove 32. When using adhesive strips, such as 13 of FIGS. 1 and 6, the provision of the slot 32 in the cylinder is not necessary.

Although various minor modifications may be suggested by those versed in the art, it should be understood that I wish to embody within the scope of the patent granted hereon all such modifications as reasonably and properly come within the scope of my contribution to the art.

I claim:

1. In a device for hooking flexible printing plates on a printing cylinder located in a rotary printing machine, said printing plates comprising at least one printing motif mounted on a supporting sheet which ends with a front hooking strip which engages in a first hook-shaped groove arranged along the generatrix of the cylinder and means for fastening and tensioning a downstream edge of the printing plate on the cylinder, the improvements comprising a stop being mounted on a face of the supporting sheet directed toward the cylinder, said stop being located adjacent the front hooking strip, said cylinder having a second groove having a cross sectional profile corresponding to the profile of the stop being positioned adjacent the first hook-shaped groove and extending parallel thereto for receiving the stop on the sheet when the sheet is fastened by said means for fastening.

2. In a device according to claim 1, wherein the cylinder has an inner chamber connected to a source of vacuum and the second groove has a series of radial channels extending to said inner chamber so that a vacuum can be applied to said second groove.

3. In a device according to claim 2, wherein the second groove is formed by a series of sub-grooves arranged end-to-end which are not in communication with each other.

4. In a device according to claim 2, wherein the supporting sheet has at least two stops, with one arranged at each lateral edge of the sheet.

5. In a device according to claim 2, wherein the second groove is in communication with a series of third grooves extending at right angles to the second groove having the shape of an arc of a circle.

6. In a device according to claim 5, wherein said third grooves have a cross sectional shape with a base which is wider than the groove at the surface of said cylinder.

7. In a device according to claim 5, wherein the second groove is formed by a plurality of sub-grooves arranged end-to-end with each of the plurality of sub-grooves being in communication with at least two of said third grooves.

8. In a device according to claim 2, which includes a plurality of third grooves extending at right angles to the second groove, said third grooves being circular grooves extending around the circumference of the cylinder.

9. In a device according to claim 8, wherein said third grooves each include a partition to sub-divide each of the third grooves into a first and second part, said partition causing a slight bending of the supporting sheet adjacent its downstream edge.

10. In a device according to claim 8, wherein each of the third grooves has a separation to sub-divide it into two parts, and each of the supporting sheets having a thin strip glued on the surface facing said cylinder adjacent the downstream edge to create a channel for interconnecting said third grooves.

11. In a device according to claim 8, wherein each of the third grooves has a cross sectional shape with a base wider than the groove at the surface of said cylinder.

12. In a device according to claim 8, wherein the second groove is formed by a plurality of sub-grooves, each sub-groove interconnecting at least two third grooves.

13. In a device according to claim 12, wherein each of the third grooves has a partition to form two parts, a downstream part being interconnected by a fourth groove, said fourth groove having channels extending into the interior of the cylinder so that a vacuum can be formed in said downstream part of each of said grooves.

14. In a device according to claim 12, wherein each of the third grooves has a cross sectional shape with a base being wider than an opening of the groove at the surface of the cylinder.

* * * * *